US006612267B1

(12) United States Patent
West

(10) Patent No.: US 6,612,267 B1
(45) Date of Patent: Sep. 2, 2003

(54) COMBINED HEATING AND HOT WATER SYSTEM

(75) Inventor: Harry R. West, Brampton (CA)

(73) Assignee: Vebteck Research Inc., Markham (CA)

( * ) Notice: Subject to any disclaimer, the term of this patent is extended or adjusted under 35 U.S.C. 154(b) by 0 days.

(21) Appl. No.: 10/224,066

(22) Filed: Aug. 20, 2002

(30) Foreign Application Priority Data

May 17, 2002 (CA) ..... 2386953

(51) Int. Cl.[7] ..... F22B 5/00

(52) U.S. Cl. ..... 122/13.3; 122/14.22; 122/14.3; 122/18.1; 237/19

(58) Field of Search ..... 122/13.3, 14.1, 122/14.2, 14.22, 14.3, 14.31, 18.1, 19.1; 237/19, 16; 126/101

(56) References Cited

U.S. PATENT DOCUMENTS

| | | | | |
|---|---|---|---|---|
| 4,554,719 A | | 11/1985 | Lewis | |
| 4,832,259 A | * | 5/1989 | Vandermeyden | 122/13.3 |
| 4,834,284 A | * | 5/1989 | Vandermeyden | 122/13.3 |
| 5,074,464 A | | 12/1991 | Moore, Jr. et al. | |
| 5,203,500 A | * | 4/1993 | Horne, Sr. | 122/13.3 |
| 5,233,970 A | | 8/1993 | Harris | |
| 5,454,429 A | | 10/1995 | Neurauter | |
| 5,701,387 A | * | 12/1997 | McGugan | 122/13.3 |
| 5,785,117 A | | 7/1998 | Grinbergs | |
| 5,829,475 A | * | 11/1998 | Acker | 122/13.3 |
| 5,855,320 A | | 1/1999 | Grinbergs | |
| 6,032,868 A | | 3/2000 | DiMarco | |
| 6,109,339 A | | 8/2000 | Talbert et al. | |

FOREIGN PATENT DOCUMENTS

| | | |
|---|---|---|
| CA | 2255181 | 12/1998 |
| EP | 0 909 933 | 12/1998 |
| EP | 1028293 | 12/1999 |

* cited by examiner

*Primary Examiner*—Jiping Lu
(74) *Attorney, Agent, or Firm*—Baker & Daniels

(57) ABSTRACT

A combination domestic hot water and space heating system has an instantaneous domestic hot water heat exchanger and a low mass boiler-type heat generator connected in a series by a boiler water flow circuit containing a circulating pump. The boiler-type heat generator has an internal reservoir containing between 10 and 20 U.S. gallons (37.85 to 75 liters) of boiler water, which is sufficient to enable the heat exchanger to supply normal short term demand, yet avoid excessive downtime thermal losses. A three-way diverter valve in the flow circuit diverts boiler water to a second heat exchanger in an air handler unit for space heating. Priority is given to domestic water heating.

20 Claims, 6 Drawing Sheets

COMBINED HEATING AND HOT WATER SYSTEM

BACKGROUND OF THE INVENTION

This invention relates to combination water and space heating systems, and in particular, to domestic water heaters used with circulating boilers.

Combination space heating and domestic hot water systems fall into two broad categories: open loop systems and closed loop systems. In an open loop system, a boiler or hot water heater produces potable hot water that is also used for heating air to satisfy the space heating requirements. It is characteristic of such systems that the boiler circulates a constantly changing supply of water as potable hot water draws are made from the system and cold supply water replaces it. It is also characteristic of such systems that the water circulated for the purpose of space heating must have the same temperature as that of the potable hot water. A difficulty with such systems is that large reservoirs or tanks of hot water are required to satisfy the demand for short term energy requirements, and such large reservoirs have high inherent energy losses.

In the closed loop system, the boiler loop is separated from the domestic hot water system, and an unchanging supply of fluid is circulated in the boiler loop. In a closed loop combination system, domestic hot water is generated by a heat exchanger whose function it is to maintain physical separation between the circulating boiler fluid and the domestic water supply. A closed loop system is somewhat more complex than an open loop system, but it offers the advantage that the boiler loop can operate at a higher temperature than the domestic hot water system.

The advantage of operating the boiler loop at a higher temperature (say 190° F.) is that if radiators or convectors are used for space heating, less heat transfer area is required to move a given amount of heat energy than if the boiler loop is limited to normal domestic hot water temperature about 140° F. (60° C.).

There have been several approaches to heat exchanger design for generating domestic hot water in closed loop combination systems. These approaches can be broadly categorized as follows:

1. Storage tank water heaters
2. Instantaneous water heaters
3. Semi-instantaneous water heaters.

In the first approach, a heat exchanger is immersed in a relatively large tank that supplies the domestic hot water. Hot water demand is met largely by stored capacitance. One advantage of the storage tank water heater is inherent temperature stability in the hot water supply due to the large thermal capacitance of the stored hot water. Another advantage is that a large flowrate may be tapped, at least until the tank is drained of hot water and the boiler cannot keep up with the demand. The disadvantage of this approach is similar to the open loop system described above, in that a large tank must be used, with the associated cost, bulk and thermal losses.

In the instantaneous water heater system, a heat exchanger without any appreciable volume is used. Heat is transferred from the boiler fluid flowing through one side of the heat exchanger to the domestic water flowing through the other side of the heat exchanger. Typically, high fluid velocity is maintained on both sides of the heat exchanger, augmenting the heat transfer coefficient and making possible a compact design relative to the heat transfer rate capacity of the unit. Operationally, the system must have a means to sense hot water draw (a flow switch). A boiler circulation pump and ignition system are energized when water flow is sensed. The advantage of the instantaneous water heater is that no hot water is stored, so that there is no corresponding thermal loss.

A difficulty with the prior art instantaneous water heater systems is that a complicated automatically modulating boiler is mandatory, since there is little thermal capacitance to absorb the energy output of the boiler energy source. The heat energy input to the boiler must closely follow the heat energy output required for the domestic hot water draw. Temperature instability due to rapid changes in the hot water flow rate is inevitable in these systems, and a complex and difficult control system must be provided to try to keep such instability to a reasonable level. Another disadvantage is that the boiler is ill-suited to respond to demand spikes, such as where a hot water tap is opened for a short period and then closed. With the instantaneous water heater, a series of demand spikes causes excessive boiler on/off cycling which is an undesirable operating mode.

In the semi-instantaneous water heater system, a compact forced convection heat exchanger is usually used inside a small storage tank of hot water which provides some thermal capacitance. An example of such a system is shown in U.S. Pat. No. 5,233,970 issued to James A. Harris. This type of system is an improvement over the instantaneous water heater, because the thermal capacitance of the water tank dampens out some of the temperature instabilities associated with the instantaneous water heaters. The thermal capacitance also eases considerably the boiler cycling problem that can arise from demand spikes. A difficulty with the semi-instantaneous system, however, is that a complex and expensive modulating boiler still must be used, again because the small storage tank cannot handle the energy output from a constant output boiler. Also, the system cannot handle short term, high demand loads. There is also undesirable lag time under high demand conditions while the boiler is ramping up its energy output.

SUMMARY OF THE INVENTION

In the present invention, an instantaneous heat exchanger is used, but with a boiler with a built in reservoir with sufficient capacity to supply normal short term demand, yet small enough to avoid excessive downtime thermal losses.

According to the invention, there is provided a hot water heater comprising an instantaneous domestic water heat exchanger having a plurality of inner flow passages for domestic water flow therethrough and means defining a domestic hot water inlet and outlet communicating therewith. The heat exchanger also has at least one boiler water passage located adjacent to the inner domestic water flow passages and means defining a boiler water inlet and outlet communicating therewith. A temperature sensor is attached to the heat exchanger to sense the temperature of the domestic hot water therein. A low mass boiler-type heat generator has an internal reservoir defining a boiler water inlet and outlet, a source of heat energy for heating water in the reservoir, and thermostatic means operably connected to the source of heat energy for maintaining the boiler water inside the reservoir between predetermined minimum and maximum temperatures. A boiler water flow circuit connects the heat exchanger and the heat generator reservoir in series. This flow circuit has a supply line for the flow of boiler water from the heat generator reservoir outlet to the heat exchanger boiler water inlet, and a return line for the flow of boiler water from the heat exchanger boiler water outlet back to the heat generator reservoir inlet. Pump means is located in the flow circuit and coupled to the domestic water temperature sensor for causing boiler water flow through the heat exchanger upon the domestic water temperature therein dropping below a predetermined temperature. Also, the heat generator reservoir is of a size large enough to enable the heat exchanger to supply short term domestic water demand and small enough-to avoid excessive downtime energy losses.

Preferred embodiments of the invention will now be described, by way of example, with reference to the accompanying drawings, in which.

Figure 1:
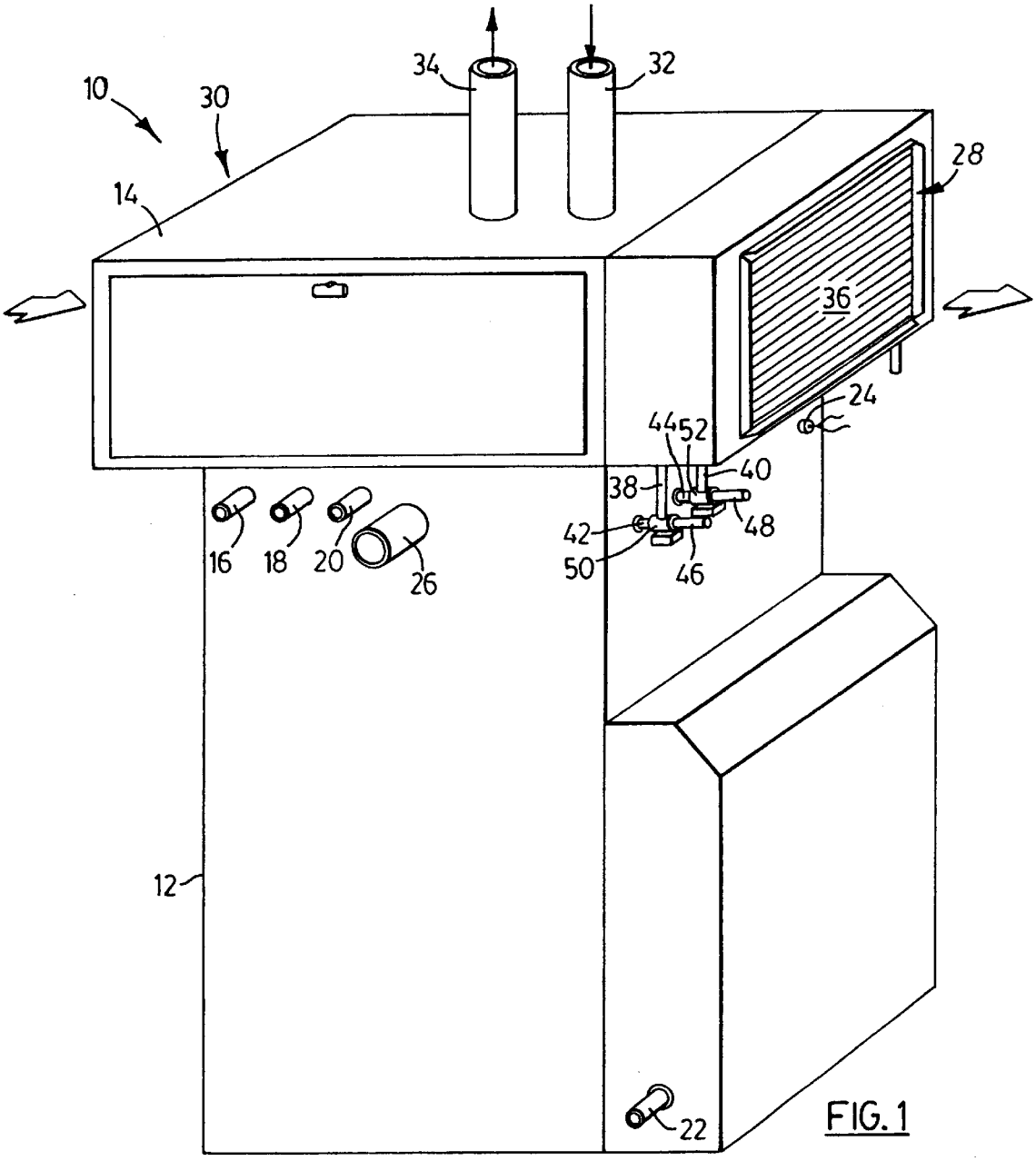
FIG. 1 is a perspective view of a preferred embodiment of a combination hot water and space heating system according to the present invention.

Referring firstly to FIG. 1, a preferred embodiment of a combination hot water and space heating system according to the present invention is generally indicated by reference numeral 10. Combination system 10 includes a lower unit 12 and an air handler unit 14. Air handler unit 14 can be detached from lower unit 12 and installed in a remote location, as described further below. Lower unit 12 includes a low mass boiler-type heat generator and an instantaneous domestic water heat exchanger, both of which will be described in greater detail below.

Combination system 10 has a water inlet fitting 16 for connection to a pressurized source of fresh water, such as a municipal water supply. A tempered or blended domestic hot water outlet fitting 18 delivers domestic hot water from combination unit 10 at a predetermined moderated temperature, typically about 120° F. The domestic hot water outlet 18 normally supplies the household hot water taps or faucets or shower heads, and the like. An optional second domestic hot water fitting 20 may be provided for delivering domestic hot water at a higher temperature, such as 140° F., to be used in dishwashers and other appliances.

Combination unit 10 has an inlet fitting 22 for supplying fuel to a source of heat energy, such as a burner, located inside lower unit 12. This fuel could be natural gas, propane or heating oil depending upon the type of burner used in combination unit 10. Alternatively, an electrical heating element could be used as the source of heat energy, in which case inlet fitting 22 would not be needed. Combination unit 10 also has an electrical connector 24 for supplying electrical power thereto. Connector 24 could also supply electrical power to a heating element if that is the source of heat energy for combination unit 10.

Combination unit 10 also has an exhaust outlet 26 where a fuel burner is used as the source of heat energy. Again, if electrical heating is used for unit 10, exhaust outlet 26 would not be provided.

Air handler unit 14 has a blower outlet 28 for supplying forced hot air for space heating requirements where combination unit.10 is used for space heating purposes. Blower outlet 28 could also supply cold air to a living space where combination unit 10 is used in an air conditioning mode. In either case, a return air inlet 30 supplies return air to air handler unit 14. A ventilator air inlet 32 and a ventilator exhaust air outlet 34 are also provided on air handler unit 14. Ventilator air inlet 32 draws in fresh air from outside and ventilator exhaust air outlet 34 exhausts stale air to the outside for heating systems which are required to have outside air ventilation incorporated therein.

As mentioned above, blower outlet 28 can supply either hot air or cold air depending upon whether combination unit 10 is used as a furnace or space heating system, or as an air conditioning system. A tube and fin type heat exchanger 36 is located adjacent to blower outlet 28. Heat exchanger 36 has inlet and outlet lines 38, 40 which can be connected alternatively to boiler water supply and return lines 42, 44, or to chilled water supply and return lines 46, 48. Three-way or diverter valves 50, 52 are used to switch between heating and cooling modes. Where combination unit 10 is used only for space heating, then the boiler water supply line 42 would be connected directly to the heat exchanger inlet 38 and the heat exchanger outlet line 40 would be connected directly to the boiler water return line 44. In this case, and the diverter valves 50, 52 would not be used.

Figure 2:
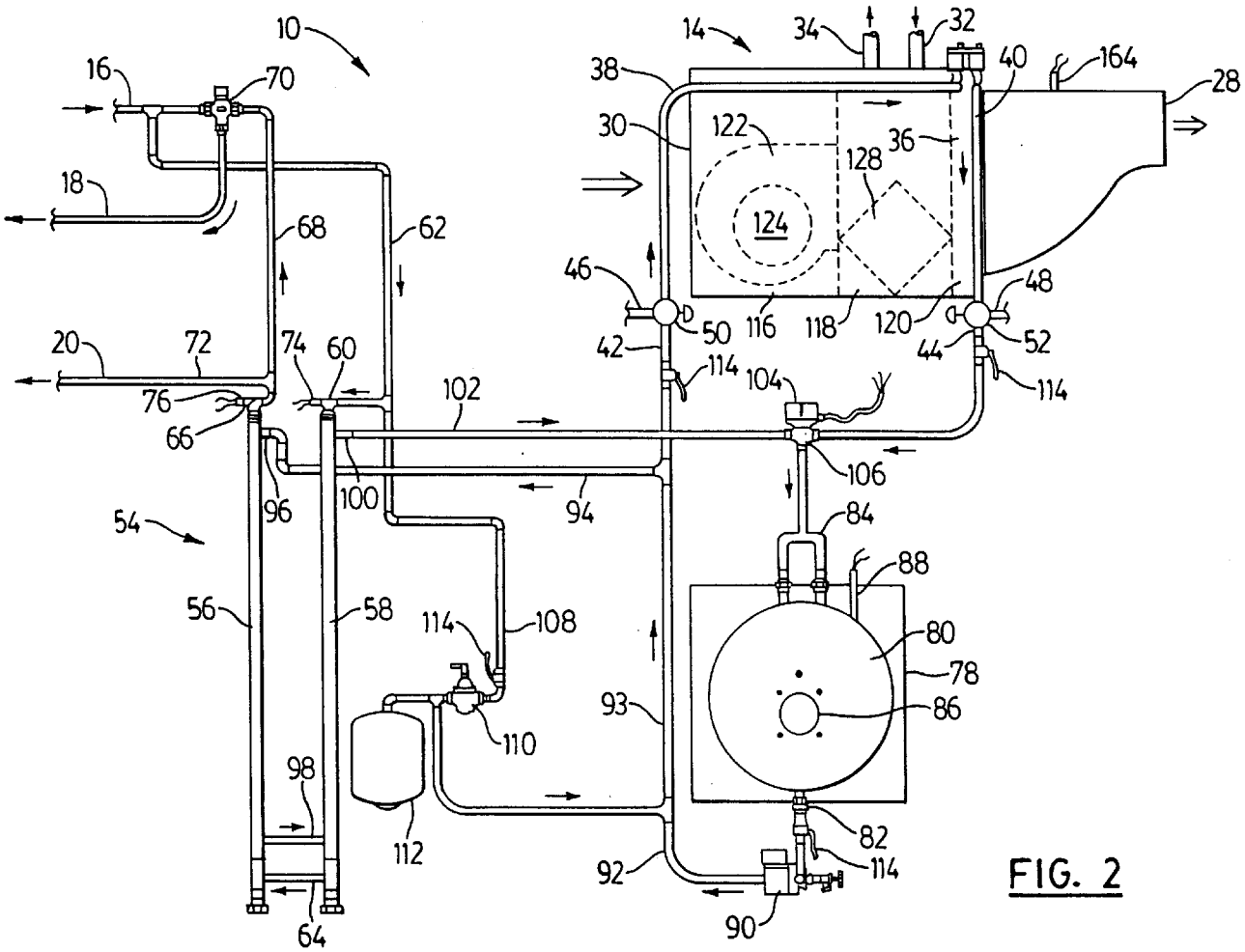
FIG. 2 is a diagrammatic flow circuit diagram for the combination system shown in FIG. 1.

Referring next to FIG. 2, combination unit 10 has an instantaneous domestic hot water heat exchanger 54, which includes two parallel tubular members 56, 58, which will be described in further detail in connection with FIG. 6. Tubular members 56, 58 are each instantaneous heat exchangers in themselves, in that they are connected together in series. A cold domestic water inlet 60 receives fresh domestic water through conduit 62 which is connected to water inlet fitting 16. This fresh domestic water passes down through the center of tubular member 58, passes through cross-over conduit 64 and up through the center of tubular member 56 to a hot domestic water outlet 66 located at the top of tubular member 56. Hot domestic water can then pass upwardly through a conduit 68 to a thermostatic mixing valve 70 or it can pass directly through conduit 72 to second hot water outlet fitting 20.

A temperature sensor 74 in the form of thermistor is mounted in domestic water inlet 60 to sense the temperature of the domestic hot water in heat exchanger 54. More particularly, temperature sensor 74, senses the domestic water inlet temperature to the heat exchanger 54. Another thermistor type temperature sensor 76 is mounted in the hot domestic water outlet 66 to sense the temperature of the hot domestic water coming out of heat exchanger 54.

A low mass boiler-type heat generator 78 has an internal reservoir 80 that holds about 16 U.S. gallons (60.5 litres) of water, but it could have a capacity of between about 10 and 20 U.S. gallons (37.85 and 75 litres). Heat generator 78 has a lower boiler outlet 82 and an upper split or dual boiler water inlet 84. A source of heat energy in the form of a burner 86 is provided to heat the boiler water inside reservoir 80. A thermostatic means has a temperature sensor 88 and is operably connected to burner 86 to maintain the boiler water inside reservoir 80 between predetermined minimum and maximum temperatures, which typically are about 160° F. and 190° F. (71.1° C. and 87.7° C.) respectively. Heat generator 78 will be described in more detail below in connection with FIGS. 4 and 5.

The boiler water outlet 82 is connected to a variable speed circulating pump 90, which delivers the hot boiler water through conduits 92, 93 and 94 to a boiler water inlet 96 in instantaneous heat exchanger 54. Hot boiler water then flows downwardly through tubular member 56, through boiler water cross-over conduit 98, and upwardly through tubular member 58 to a boiler water outlet 100 of heat exchanger 54. A boiler water return line 102 then delivers the boiler water to a three way-valve 104, and then through a valve outlet 106 back to heat generator boiler water inlet 84 to complete the boiler water flow circuit connecting the heat exchanger 54 and the heat generator reservoir 80 in series.

Makeup water is supplied to the boiler water flow circuit through a makeup conduit 108 which is connected to the domestic water inlet conduit 62. A conventional system fill valve 110 and an expansion tank 112 are also provided for the boiler water flow circuit.

Figure 3:
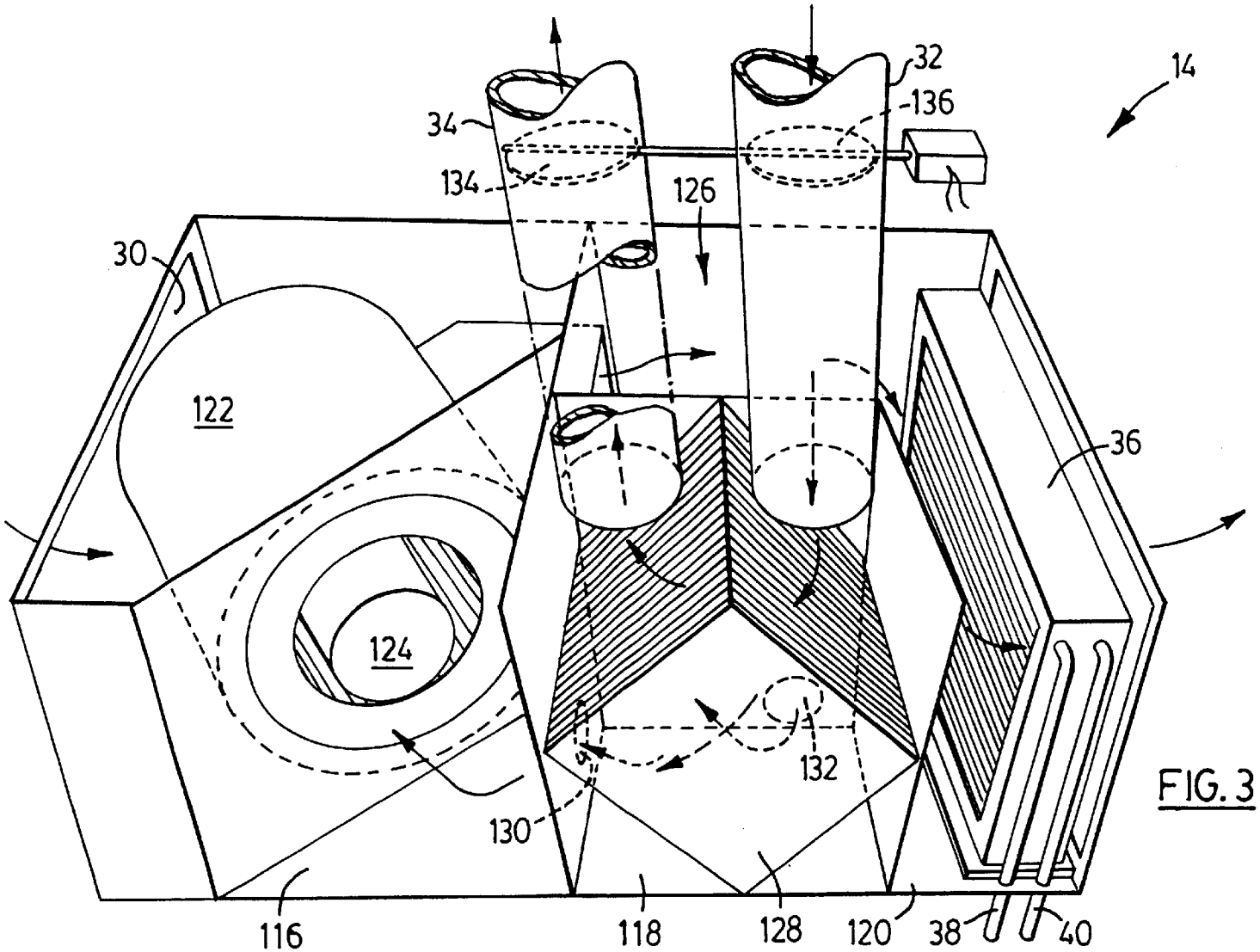
FIG. 3 is cut-way perspective view of the air handler unit used in the combination system shown in FIG. 1.

Ball type shut-off valves 114 are provided in various locations in the flow conduits of system 10 to allow for maintenance without having to drain the entire system. The entire system holds about 18 U.S. gallons (68.1 litres) of water. The various conduits used in system 10 are made of three-quarter inch internal diameter tubing made of aluminum with a high density polyethylene internal and external cladding, which is sold under the trademark PEX-AL-PEX. The reservoir 80 of heat generator 78 is insulated with three-quarter inch foil backed glass fiber insulation with additional outer layers of three quarter inch foil backed foam rubber insulation sold under the trademark RUBATEX. The instantaneous heat exchanger tubular members 56 and 58 are also heavily insulated with foil backed glass fiber, and the various conduits are insulated as well with suitable pipe insulation, so that the downtime thermal losses for the entire system are minimized:

Referring next to FIG. 3, air handler unit 14 will now be described in further detail. Air handler unit 14 has a blower compartment 116, a ventilator compartment 118 and a heat exchanger compartment 120. Blower compartment 116 has a squirrel-cage type blower 122 powered by an electronically commutated motor 124 which runs between typically between 200 and 1000 rpm to deliver between 200 and 2000 cfm using a 10 inch by 10 inch blower wheel. The output of blower 122 passes through a transitional passage 126 behind ventilator compartment 118 and then into heat exchanger compartment 120 where it passes out through heat exchanger 36.

Ventilator compartment 118 has a ventilator heat exchanger 128 located therein. Ventilator heat exchanger 128 is made in accordance with U.S. Pat. Nos. 4,554,719 and 5,785,117 and it is made up of a stack of spaced aluminum sheets that are joined along opposite edges in an alternate arrangement to define two separate sets of air passages for the respective incoming and outgoing ventilation air flows. The inlet airflow circuit receives outside fresh air from ventilator inlet 32 which passes through ventilator heat exchanger core 128 and out through an opening 130 in the wall separating blower compartment 116 and ventilator compartment 118. This flow joins the return airflow coming into blower 122, so that some fresh air is drawn in and mixed with the hot air outlet of air handler unit 14. A ventilator exhaust circuit receives some of the air in transitional passage-126 through a bypass port 132 in the back wall of ventilator compartment 118, and passes this air up and out through ventilator exhaust air outlet 34. It will be appreciated that opening 130 is an inlet flow port in communication with the blower inlet and the ventilator heat exchanger inlet circuit for drawing ventilator air through the ventilator heat exchanger. Also, bypass port 132 is in communication with the blower outlet and the ventilator heat exchanger exhaust circuit for exhausting a portion of the space heating return air. The amount of ventilation flow is controlled by a pair of dampers 134, 136.

Figure 4:
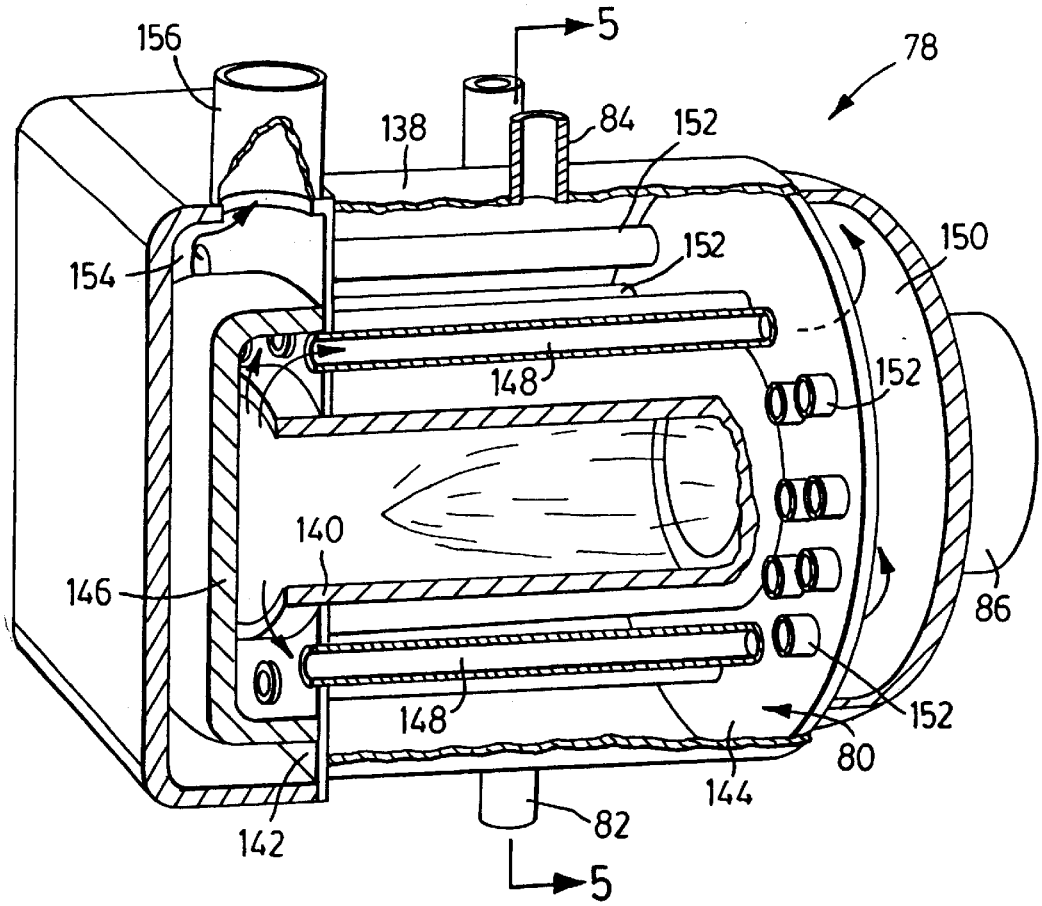
FIG. 4 is a perspective view, partly broken away, of the low mass boiler-type heat generator used in the system of FIG. 1.
Figure 5:
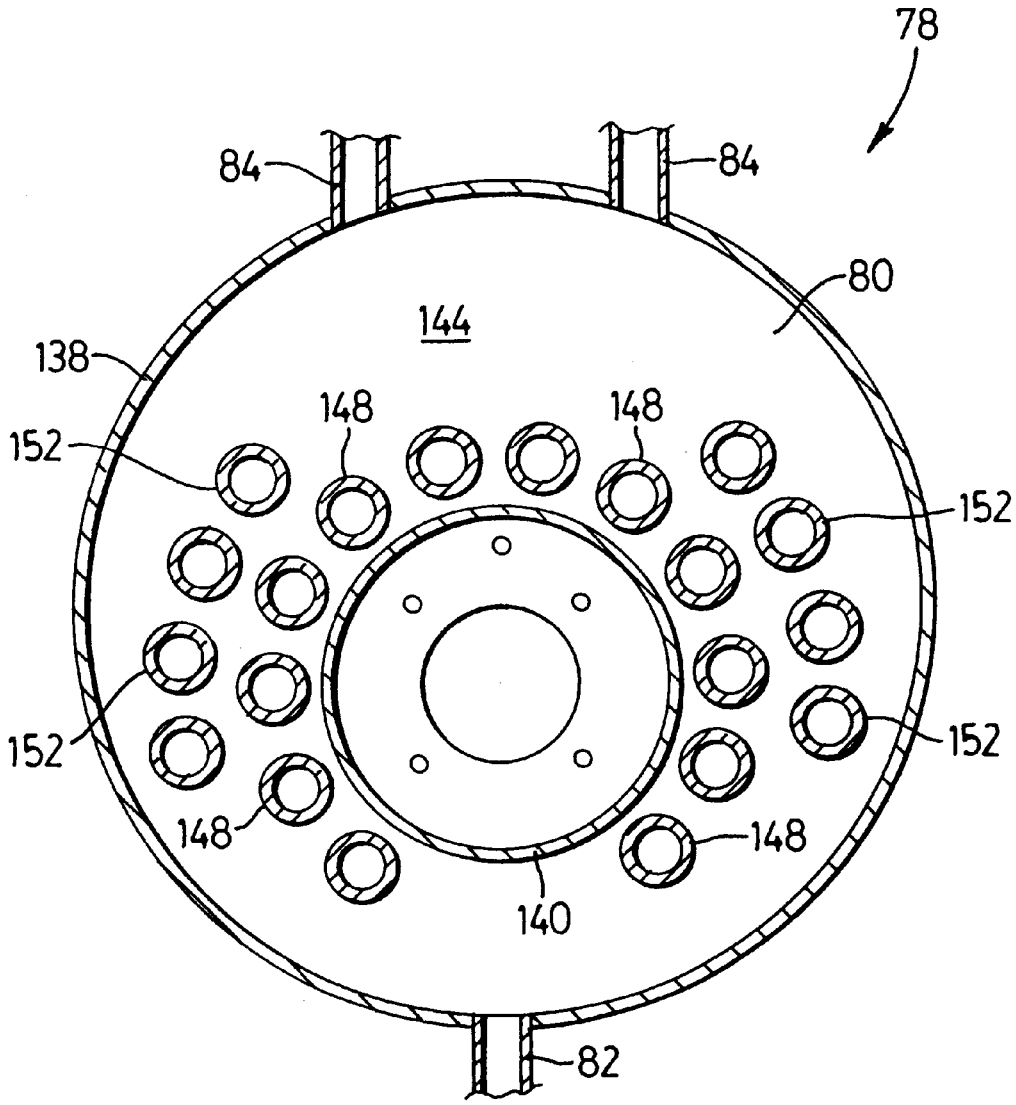
FIG. 5 is a sectional view taken along lines 5—5 of FIG. 4.

Referring next to FIGS. 4 and 5, heat generator 78 includes a hollow, cylindrical tank or shell 138 that defines reservoir 80. A central inner axial tube 140 extends between end walls 142 and 144 and together, central tube 140 and end walls 142, 144 and shell 138 define the inner boundaries of reservoir 80. As indicated in FIG. 4, central tube 140 is the burner tube which receives the flame of burner 86. An inner end plate 146 receives the hot combustion products and transfers them radially to a plurality of radially arranged inner tubes 148. The hot combustion gases are then passed into an end compartment 150 where they turn direction radially and flow out through outer longitudinal tubes 152. The hot combustion gases emerging from outer tubes 152 then pass into a final outer compartment 154 and exit out through an exhaust outlet 156. Exhaust outlet 156 is connected to system exhaust outlet 26 (see FIG. 1). The longitudinal tubes 140, 148 and 152 are thus connected in series to form a three-pass, tubular energy input source to transmit the heat energy produced by burner 86 through the tubes to the water and reservoir 80. It will be appreciated that an electric heating element could be used instead of burner 86, the heated air generated by such an electrical element would still pass through tubes 148 and 152 to heat the water in the reservoir 80. Whether a combustion burner or an electrical heating element is used in the heat generator 78, a constant predetermined energy input rate is supplied to heat generator 78, as described further below.

Figure 6:
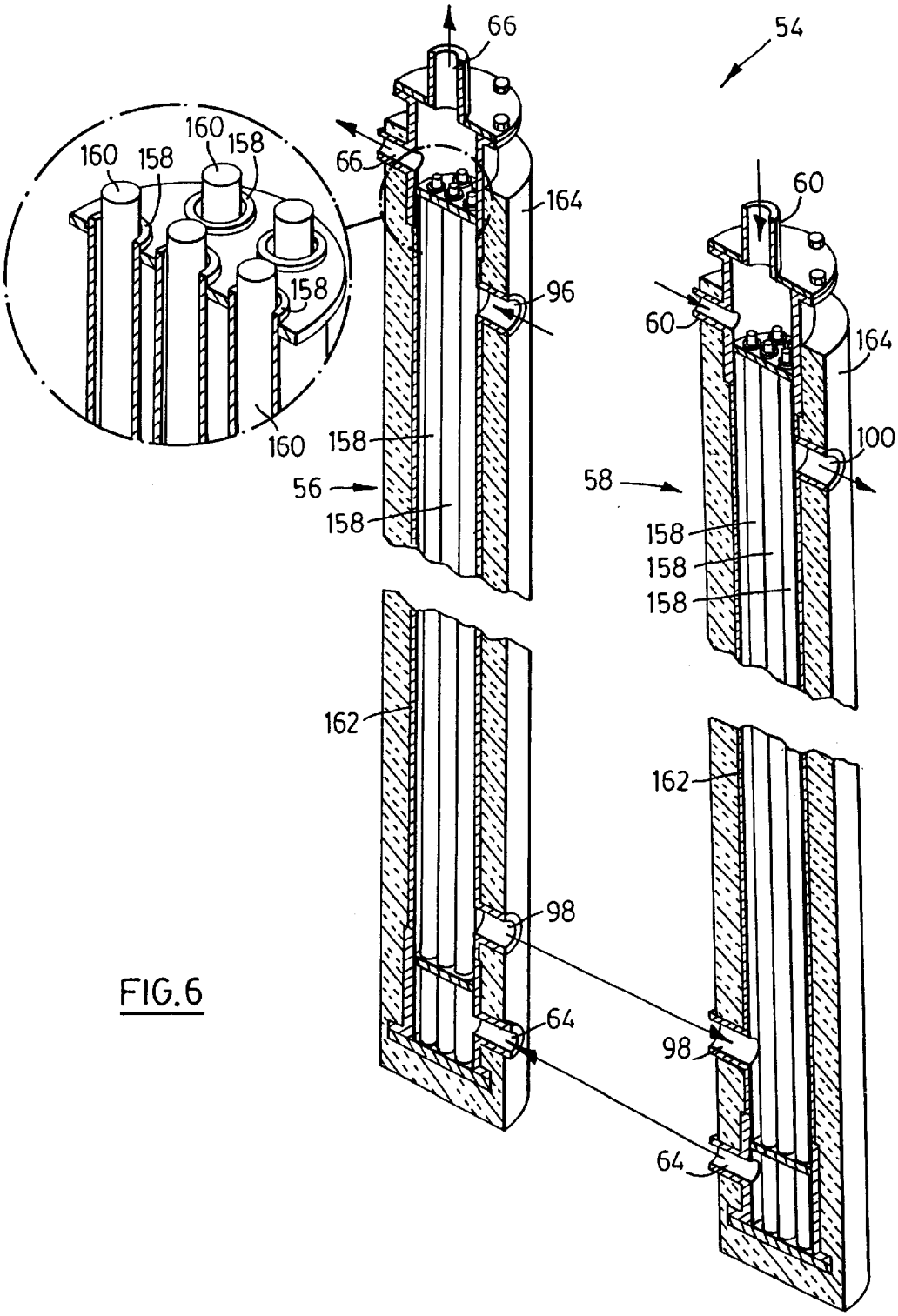
FIG. 6 is a sectional perspective view of the instantaneous domestic hot water heat exchanger of the system shown in FIG. 1.

Referring next to FIG. 6, the tubular members 56, 58 of instantaneous heat exchanger 54, are made generally in accordance with the heat exchangers described in U.S. Pat. No. 5,454,429. These are shell and tube type heat exchangers and they have seven internal copper tubes 158 through which the domestic hot water passes. Each tube 158 contains a free floating glass fiber rod 160 located therein. The outer shells 162 are made of copper and have a length of about 1.5 m and an outside diameter of about 3.5 cm. The domestic hot water capacity of heat exchanger 54 is less than 0.52 U.S. gallons (2 litres). Foil backed glass fiber insulation 164 surround shells 162. Additional insulation can also be used as well.

A solid state control module (not shown) is provided in system 10 to receive the inputs from the various temperature sensors and control the burner 86, circulating pump 90, blower motor 124 and dampers 134, 136. The control module senses through temperature sensor 88, the temperature inside reservoir 80 and operates burner 86 to maintain the boiler water temperature inside reservoir 80 between 160° F. and 190° F. When the temperature of the domestic hot water inside the instantaneous heat exchangers 54, as sensed by temperature sensor 74, drops below 90° F. (32.2° C.), circulating pump 90 is activated to circulate the hot boiler water through instantaneous heat exchanger 54. This maintains the domestic water temperature inside instantaneous heat exchanger 54 between about 90° F. (32.2° C.) and 140° F. (60° C.).

If there is a call for domestic hot water through either of the hot water outlet fittings 18 or 20, fresh domestic water will be supplied through conduit 62 to cold domestic water inlet 60, and this almost immediately causes temperature sensor 74 to activate circulating pump 90 and heat the incoming domestic water in heat exchanger 54. The domestic water inside heat exchanger is normally heated so that the hot domestic hot water output as sensed by temperature sensor 76 is about 140° F. (60° C.). If the domestic hot water draw is taken through hot water outlet fitting 18, thermostatic mixing valve mixes cold water with heated domestic hot water received through conduit 68, so that the domestic hot water delivered through outlet fitting 18 is normally about 120° F. (48.8° C.). This arrangement satisfies most of the normal domestic hot water demand requirements for a typical household. Higher demand rates, however, are a function of the energy input to burner 86.

By way of example, the BTU per hour energy input required of burner 86 to raise the temperature of the incoming domestic water by 90° F. (32.2° C.) for various output rates is as follows:

| OUTPUT FLOW | Rates Required |
|---|---|
| 4.0 U.S. GPM (15.14 liters/minute) | 179,280 BTU (52.5 kW) |
| 3.0 U.S. GPM (11.35 liters/minute) | 134,460 BTU (39.40 kW) |
| 2.0 U.S. GPM (7.57 liters/minute) | 89,640 BTU (26.27 kW) |

From the above, it will be appreciated that the desired domestic hot water flow rate out of hot water outlet fittings 18 or 20 will dictate the size or BTU/hour output of the burner 86 required for system 10. If the domestic hot water draw through outlet fitting 18 or 20 exceeds the input or recovery rate of burner 86, the temperature of the domestic hot water output will drop, but usually not more than about 15° F. (9.4° C.).

The control module for system 10 senses the domestic hot water outlet temperature through temperature sensor 76, and if it exceeds 135° F. (57.2° C.), it reduces the speed of circulating pump 90 to save energy. The flow rate through pump 90 typically varies between 3 and 12 U.S. gallons/minute (7.7 and 45.4 litres per minute).

If there is any domestic hot water draw through outlet fitting 18 or 20, three-way valve 104 switches to direct all of the boiler water flow through domestic hot water heat exchanger 54, thus giving priority to the domestic hot water production in system 10. This domestic hot water draw is sensed by temperature sensor 74 dropping below its set point of 90° F. (32.2° C.). Even if there is no domestic hot water draw, if the temperature of sensor 74 drops below the set point of 90° F. (32.2° C.), this starts circulating pump 90. This ensures that there is always a small supply of domestic hot water in heat exchanger 54 above the 90° F. (32.2° C.) temperature. Normally, however, the domestic hot water temperature inside heat exchanger 54 ranges between 90° (32.2° C.) and about 140° F. (60° C.), and as mentioned above, if it exceeds 135° F. (57.20° C.), the speed of circulating pump 90 is slowed down to avoid excessive temperatures inside heat exchanger 54. There is nothing wrong with the domestic hot water reaching high temperatures inside heat exchanger 54, but this is unnecessary and could result in unwanted thermal downtime losses.

If there is no domestic hot water demand from system 10, then air handler unit 14 can address the space heating demand from system 10. Space heating demand is sensed by a conventional room air thermostat (not shown), and if there is a call for space heating, three-way valve 104 diverts the boiler water flow through heat exchanger 36 and blower 122 is started to force air through heat exchanger 36. Heat exchanger 36 is a four pass tube and fin type heat exchanger typically about 25 inches wide and 20 inches high, and can deliver heated air at an output rate typically between about 40,000 BTU/hour (11.7 kW/hour) and 137,000 BTU/hour (40.15 kW/hour) depending upon the boiler water flow rate therethrough, the air flow rate produced by blower 122, and the heat energy input of burner 86. Usually, the blower output is determined by the ducting requirements of the space to be heated and the boiler water flow rate through heat exchanger 36 is chosen to produce about a 60° F. (15.5° C.) to 65° F. (18.3° C.) temperature rise over room air temperature. A temperature sensor 164 (see FIG. 2) is located in front of heat exchanger 36 to sense the hot air output and from this the system control module can vary the output of blower 122 plus or minus 15% to maintain a desired hot air output temperature.

If no hot air space heating is required, blower 122 still operates at low speed to produce a ventilation flow through ventilator heat exchanger 128 at about 63.8 CFM (30 litres/second). At this slow speed, dampers 134 and 136 are opened. Blower 122 can also have a higher speed for high speed ventilation at about 140 CFM (60 to 70 litres/second). When blower 122 is operating at normal speed for space heating, dampers 134 and 136 are partially closed to maintain a ventilation flow rate of about 63.8 CFM (30 litres/second).

When air handler unit 14 is operated as an air-conditioning unit, diverter valves 50, 52 switch to allow chilled water to flow through heat exchanger 36 and dampers 134, 136 are closed, so that there is no ventilation air flow. In the air conditioning mode, blower 122 can have yet another speed suitable for air conditioning purposes.

It will be appreciated that lower unit 12 of system 10 can be used by itself without an air handler unit 14 where only domestic hot water heating is required. The lower unit 12 can also be used for domestic water heating and space heating without air handler 14 where the boiler water supply and return lines 42, 44 are connected to a hot water radiator system or an in-floor radiant heating system.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A hot water heater comprising:

an instantaneous domestic water heat exchanger having a plurality of inner flow passages for domestic water flow therethrough and means defining a domestic hot water inlet and outlet communicating therewith, said heat exchanger also having at least one boiler water passage located adjacent to the inner domestic water flow passages and means defining a boiler water inlet and outlet communicating therewith;

a temperature sensor attached to the heat exchanger to sense the temperature of the domestic hot water therein;

a low mass boiler-type heat generator having an internal reservoir defining a boiler water inlet and outlet, a source of heat energy for heating water in the reservoir, and thermostatic means operably connected to the source of heat energy for maintaining the boiler water inside the reservoir between predetermined minimum and maximum temperatures;

a boiler water flow circuit connecting the heat exchanger and the heat generator reservoir in series, said circuit having a supply line for the flow of boiler water from the heat generator reservoir outlet to the heat exchanger boiler water inlet, and a return line for the flow of boiler water from the heat exchanger boiler water outlet back to the heat generator reservoir inlet;

pump means located in the flow circuit and coupled to the domestic water temperature sensor for causing boiler water flow through the heat exchanger upon the domestic water temperature therein dropping below a predetermined temperature; and the heat generator reservoir being of a size large enough to enable the heat exchanger to supply short term domestic water demand and small enough to avoid excessive downtime energy losses.

2. A hot water heater as claimed in claim 1, wherein the size of the heat generator reservoir is such that it has a capacity of between 10 and 20 U.S. gallons (38.8 litres and 75.7 litres).

3. A hot water heater as claimed in claim 1, wherein the boiler water inside the reservoir is maintained between minimum and maximum temperatures of 160° F. (71.1° C.) and 190° F. (87.7° C.) respectively.

4. A hot water heater as claimed in claim 1, wherein the pump means includes a variable speed pump, and further comprising means for sensing the domestic water outlet temperature and means for varying the pump speed in response to the domestic water outlet temperature.

5. A hot water heater as claimed in claim 4, wherein the pump speed varies such that the flow rate therethrough is between 3 and 12 U.S. gallons (11.3 litres and 45.4 litres) per minute.

6. A hot water heater as claimed in claim 1, wherein the heat generator includes a hollow cylindrical tank having longitudinal tubes connected together in series therein to form a three-pass, tubular energy input source, the source of heat energy being transmitted through said tubes.

7. A hot water heater as claimed in claim 6, wherein the source of heat energy is a burner.

8. A hot water heater as claimed in claim 1, wherein the instantaneous heat exchanger is a shell and tube type heat exchanger having a plurality of parallel tubes for heating domestic hot water, the domestic hot water fluid capacity of the heat exchanger being less than two litres.

9. A hot water heater as claimed in claim 8, wherein the heat exchanger shell has a length of about 1.5 metres and an outside diameter of about 3.5 centimetres.

10. A hot water heater as claimed in claim 9, wherein the heat exchanger contains seven spaced-apart tubes for domestic water, each tube containing a free floating rod loosely located therein.

11. A hot water heater as claimed in claim 1, wherein the temperature sensor predetermined temperature for activating the pump means is 90° F. (32.2° C.).

12. A hot water heater as claimed in claim 11, wherein the temperature'sensor is located to sense the temperature at the domestic hot water inlet.

13. A hot water heater as claimed in claim 10, wherein the temperature sensor predetermined temperature for activating the pump means is 90° F. (32.2° C.).

14. A hot water heater as claimed in claim 1 and further comprising a thermostatic mixing valve adapted to be coupled between a source of domestic water and the outlet of the domestic water heat exchanger, the mixing valve having an outlet for supplying tempered domestic hot water on demand.

15. A hot water heater as claimed in claim 1, wherein the boiler heat energy source has a constant predetermined energy input rate.

16. A hot water heater as claimed in claim 1 and further comprising an air handler unit for space heating, the air handle unit including a space heating heat exchanger coupled to the boiler water circuit in parallel with the domestic heat exchanger and a blower for forcing air through the space heating heat exchanger, and further comprising a three-way valve for alternatively directing the boiler water flow between the domestic water heat exchanger and the space heating heat exchanger.

17. A hot water heater as claimed in claim 16 and further comprising a controller connected to the three-way valve, the controller being connected to the domestic water temperature sensor to switch the valve giving boiler water priority to the domestic water heat exchanger upon demand for hot water.

18. A hot water heater as claimed in claim 17, wherein the fan motor is an electronically commutated motor.

19. A hot water heater as claimed in claim 16, wherein the air handler unit further comprises ventilator heat exchanger having an inlet circuit and an exhaust circuit, the air handler unit defining an inlet flow port in communication with the blower inlet and the ventilator heat exchanger inlet circuit for drawing ventilator air through the ventilator heat exchanger, and the air handler unit defining a further bypass port in communication with the blower outlet and the ventilator heat exchanger exhaust circuit for exhausting a portion of the space heating air.

20. A hot water heater as claimed in claim 19, wherein the air handler unit defines ventilation inlet and exhaust ports in communication respectively with the ventilator inlet and exhaust circuits, and further comprising damper means in said inlet and exhaust ports for controlling the ventilator flow.

* * * * *